United States Patent [19]

Maxey

[11] 4,004,568

[45] Jan. 25, 1977

[54] METHOD AND APPARATUS FOR DRESSING REGULATING WHEELS FOR CENTERLESS GRINDERS

[75] Inventor: Van Q. Maxey, Morgan Hill, Calif.

[73] Assignee: Engelhard Minerals & Chemicals Corporation, Murray Hill, N.J.

[22] Filed: July 18, 1975

[21] Appl. No.: 597,022

[52] U.S. Cl. ..... 125/11 TP; 51/100 R; 51/103 TF; 125/11 NT

[51] Int. Cl.[2] ..... B24B 17/02; B24B 53/04

[58] Field of Search ..... 125/11 R, 11 CD, 11 TP; 51/251, 254, 289 R, 103 TF, 95 WH, 95 R, 232, 100 R

[56] References Cited

UNITED STATES PATENTS

| | | | |
|---|---|---|---|
| 1,515,568 | 11/1924 | Fleming | 51/232 X |
| 2,004,283 | 6/1935 | Hurt | 51/232 |
| 2,115,908 | 5/1938 | Fox | 51/289 R X |
| 2,220,768 | 11/1940 | Indge | 51/95 WH |
| 2,766,559 | 10/1956 | Pixley | 51/289 R X |
| 2,855,729 | 10/1958 | Render | 51/103 TF |
| 3,314,410 | 4/1967 | Knauer | 125/11 R |
| 3,902,281 | 9/1975 | McCord | 51/232 X |

*Primary Examiner*—Al Lawrence Smith
*Assistant Examiner*—Nicholas P. Godici

[57] ABSTRACT

Method and apparatus for automatically dressing a regulating wheel to the required curvature for a centerless grinding operation. A dressing wheel is mounted for rotation about an axis which is inclined to a reference axis. The regulating wheel is mounted on a gimbal assembly which permits the axis of that wheel to be oriented as desired with respect to the axis of the dressing wheel, and the gimbal assembly is mounted on a carriage which is movable in directions parallel and normal to the reference axis. With the axis of the regulating wheel positioned as desired and the wheels in peripheral engagement, the wheels are rotated and moved relative to each other in a direction parallel to the reference axis to dress the regulating wheel. The angle between the axis of the dressing wheel and the reference axis is made to correspond to the angle at which the axis of the regulating wheel is inclined to feed workpieces past the grinding wheel in a centerless grinder. The gimbal assembly is adjusted to form the regulating wheel face with an angle for stock removal, and the carriage is positioned longitudinally to form the regulating wheel to accommodate workpieces a desired distance from the center line of the regulating and grinding wheels. In one embodiment, a follower affixed to the gimbal assembly engages a stationary template to pivot the gimbal assembly and form a desired stock removal contour on the face of the regulating wheel.

12 Claims, 4 Drawing Figures

METHOD AND APPARATUS FOR DRESSING REGULATING WHEELS FOR CENTERLESS GRINDERS

BACKGROUND OF THE INVENTION

This invention pertains generally to centerless grinding equipment and more paticularly to a method and apparatus for dressing regulating wheels for use in centerless grinding machines.

In centerless grinders the workpiece is carried on a support or blade between two rotating wheels, one of which is a grinding wheel rotating at a normal grinding speed. The other wheel is a regulating wheel which rotates in the same direction as the grinding wheel but at a much slower speed. The regulating wheel does not grind the workpiece but rotates it at a uniform speed against the grinding wheel, and the size of the finished workpiece is determined by the distance between the peripheral edges of the two wheels.

The axis of the regulating wheel is commonly inclined at a slight angle, known as the helix angle, with respect to the axis of the grinding wheel to cause the rotating workpieces to feed longitudinally past the face of the grinding wheel. The inclination is in a direction normal to the center line of the wheels, and the regulating wheel is formed with a longitudinally curved face to provide a desired relationship between the faces of the wheels. The curvature required is determined by the helix angle and the relationship desired, and it is difficult to define mathematically. For parallel faces and a helix angle on the order of 5°, for example, the face of the regulating wheel is slightly concave with a curvature which is generally parabolic toward the center and hyperbolic toward the ends. If the surface of the regulating wheel is to be inclined, e.g., for tapering workpieces fed a limited distance between the wheels or removing a predetermined amount of material from a workpiece fed through the wheels, the curvature must be adjusted accordingly.

Heretofore, regulating wheels have formed or dressed by a single point cutting tool, sometimes using a template of the desired curvature as a guide. This method is time consuming, and it generally requires a skilled technician both in the preparation of the template and in the actual dressing operation. Moreover, single point dressing tools are not suitable for use on some newer regulating wheels which are made of harder materials, e.g., diamonds, than wheels heretofore provided.

SUMMARY AND OBJECTS OF THE INVENTION

The invention provides a method and apparatus for automatically dressing a regulating wheel to the desired curvature for a centerless grinding operation. A dressing wheel is mounted for rotation about an axis which is inclined to a reference axis by an angle corresponding to the helix angle. The regulating wheel is mounted on a gimbal assembly which permits the axis of that wheel to be oriented as desired with respect to the axis of the dressing wheel, and the gimbal assembly is mounted on a carriage which is movable in directions parallel and normal to the reference axis. With the axis of the regulating wheel positioned as desired and the wheels in peripheral engagement, the wheels are rotated and moved relative to each other in a direction parallel to the reference axis to dress the regulating wheel. The helix angle is determined by the angle between the dressing wheel axis and the reference axis, the gimbal assembly can be adjusted to form the regulating wheel face with a desired angle for stock removal, and the carriage can be positioned longitudinally to form the wheel to accommodate workpieces a desired distance from the center line of the regulating and grinding wheels. In one embodiment, a follower affixed to the gimbal assembly engages a stationary template to pivot the gimbal assembly and form a desired stock removal contour on the face of the regulating wheel.

It is in general an object of the invention to provide a new and improved method and apparatus for dressing regulating wheels for centerless grinders.

Another object of the invention is to provide a method and apparatus of the above character in which the regulating wheel is formed with the desired curvature accurately and automatically.

Additional objects and features of the invention will be apparent from the following description in which the preferred embodiments are set forth in detail in conjunction with the accompanying drawings.

DETAILED DESCRIPTION

Figure 1:
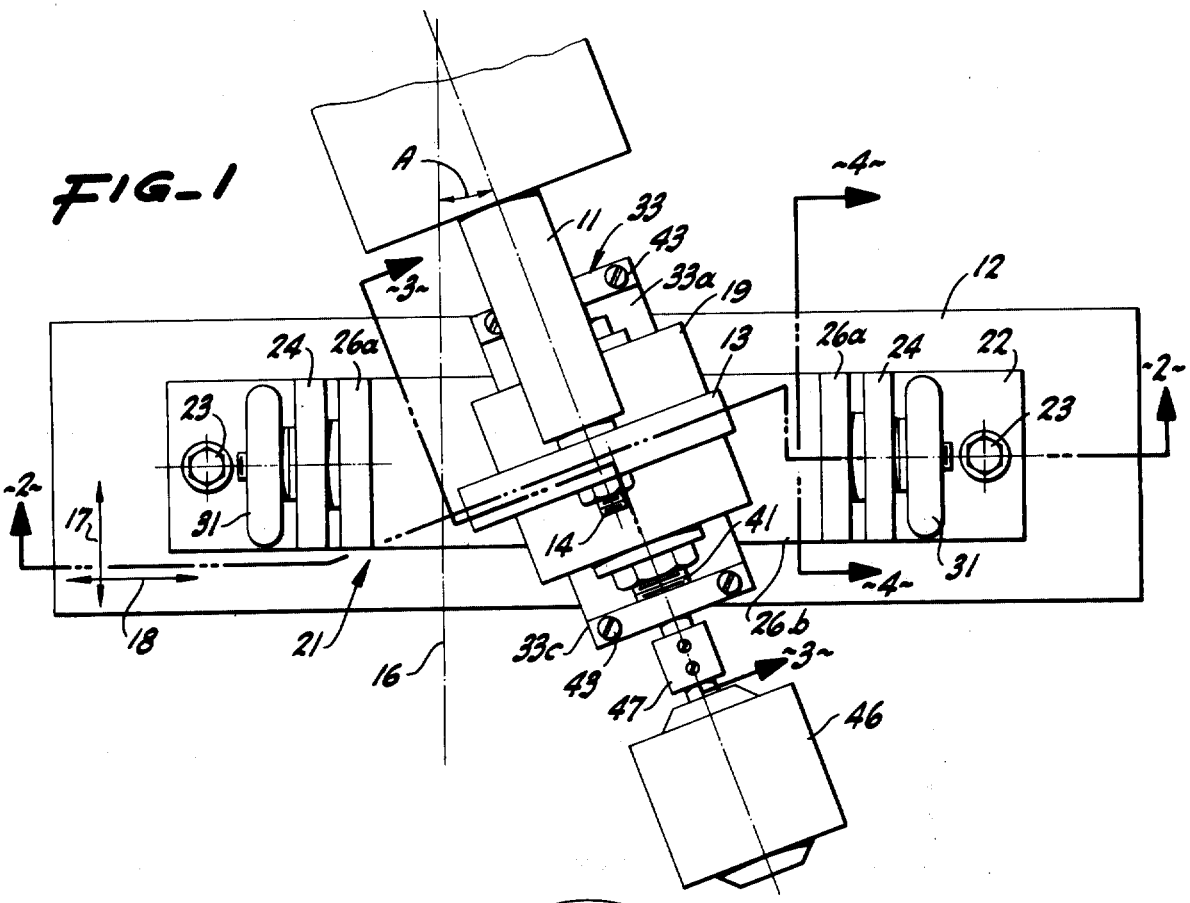
FIG. 1 is a top plan view of one embodiment of apparatus for dressing regulating wheels according to the invention.

As illustrated in the drawings, the apparatus includes a grinding head 11 and a carriage 12 which, in the embodiment illustrated, are the grinding head and table of a conventional surface grinder. A cylindrical dressing wheel 13 is mounted on a horizontally extending drive spindle 14 in the grinding head, and the grinding head can be swung about a verticle axis to set the axis of the spindle at a desired angle A relative to a horizontally extending reference axis 16. The grinding head can be moved vertically to adjust the height of the dressing wheel above the carriage.

Carriage 12 is mounted on ways or other suitable means, not shown, for horizontal movement in a first direction parallel to reference axis 16, as indicated by arrow 17, and in a second direction normal to the reference axis, as indicated by arrow 18. Hereinafter, the direction indicated by arrow 17 is referred to as the transverse direction, and the direction indicated by arrow 18 is referred to as the longitudinal direction.

Means is provided for rotatively mounting a regulating wheel 19 on the carriage in position to be peripherally engaged by the dressing wheel. This means includes a gimbal assembly 21 having a base 22 secured to the carriage by bolts 23. The base includes a pair of longitudinally spaced uprights 24 on which a U-shaped cradle 26 is pivotally mounted.

Cradle 26 includes a pair of longitudinally spaced arms 26a and a base portion 26b. Axially aligned studs 27 are threadedly mounted in the arms of the cradle and extend longitudinally through clearance holes 28 in uprights 24. Annular spacers 29 are provided between the uprights and cradle arms, and hand wheels 31 are threadedly mounted on the outer ends of studs 27 for securing the cradle in a desired rotative position about the axis of the studs.

The gimbal assembly also includes a U-shaped support bracket 33 which is pivotally mounted on the base portion of cradle 26 for movement about an axis normal to the axis of studs 27. The support bracket includes a base portion 33a and a pair of spaced apart arms 33b. A stud 34 is threadedly mounted in the base portion of the cradle and extends through a clearance hole 36 in the base portion of the support bracket. An annular spacer 37 is provided between the base portions of the cradle and support bracket, and a nut 38 is threadedly mounted on stud 34 for securing the support bracket in a desired position about the stud.

The regulating wheel is mounted on a spindle 41 which is rotatively mounted in bearings 42 carried by the arms of support bracket 33. The bearings are retained by caps 33c secured to the upper portions of the support bracket arms by screws 43. Spindle 41 extends in a direction parallel to the base portion of the support bracket, and it includes a threaded central portion 41a and outer portions 41b of reduced diameter. The regulating wheel is disposed coaxially of the threaded portion of the spindle and secured thereto by nuts 44.

Means such as a drive motor 46 is provided for rotating regulating wheel 19 about its axis. The output shaft of the motor is connected to spindle 41 by a coupling 47, and the motor is mounted for movement in concert with support bracket 33 by suitable means, not shown.

Operation and use of the apparatus and therein the method of the invention can now be described. It is assumed that dressing wheel 13 and regulating wheel 19 have been mounted on spindles 14 and 41, respectively, and that the regulating wheel is to be dressed to provide automatic feeding of workpieces in a centerless grinding machine.

Grinding head 11 is adjusted to make angle A between the axis of the dressing wheel and reference axis 16 equal to the desired helix angle, that is the angle at which the regulating wheel will be inclined in the grinding machine to feed workpieces past the grinding wheel. If automatic feeding were not desired, angle A would be zero, and the axis of the dressing wheel would coincide with the reference axis.

Once the grinding head has been set to the desired helix angle, the axis of the regulating wheel is aligned with the axis of the dressing wheel by rotating support bracket 33 about the axis of stud 34. The bracket is secured in the desired position by tightening nut 38.

Carriage 12 is then positioned longitudinally according to the position at which workpieces are to be ground relative to the center line of the grinding wheel and the regulating wheel. The axis of the regulating wheel is offset from the axis of the dressing wheel by a distance D corresponding to the distance from the center line at which the grinding is to be done. If the grinding were to be done on the center line, distance D would be zero, and the two axes would be aligned vertically.

If the face of the regulating wheel is to be formed at an angle for removing stock from a workpiece, cradle 26 is pivoted about the axis of studs 27 to incline the axis of the regulating wheel at an angle B relative to the axis of the dressing wheel. The cradle is set so that angle B equals the angle desired on the face of the wheel, and the cradle is locked in the desired position by tightening hand wheels 31.

With the axes of the dressing wheel and regulating wheel set in their desired orientations, motor 46 and the motor in grinding head 11 are energized to rotate the wheels about their axes. The grinding head is then lowered to bring the wheels into peripheral engagement, and carriage 12 is moved back and forth in the transverse direction, i.e., parallel to the reference axis. As the carriage is moved and material is removed from the regulating wheel, the grinding head can be lowered further until the regulating wheel is formed to the desired contour.

Figure 4:
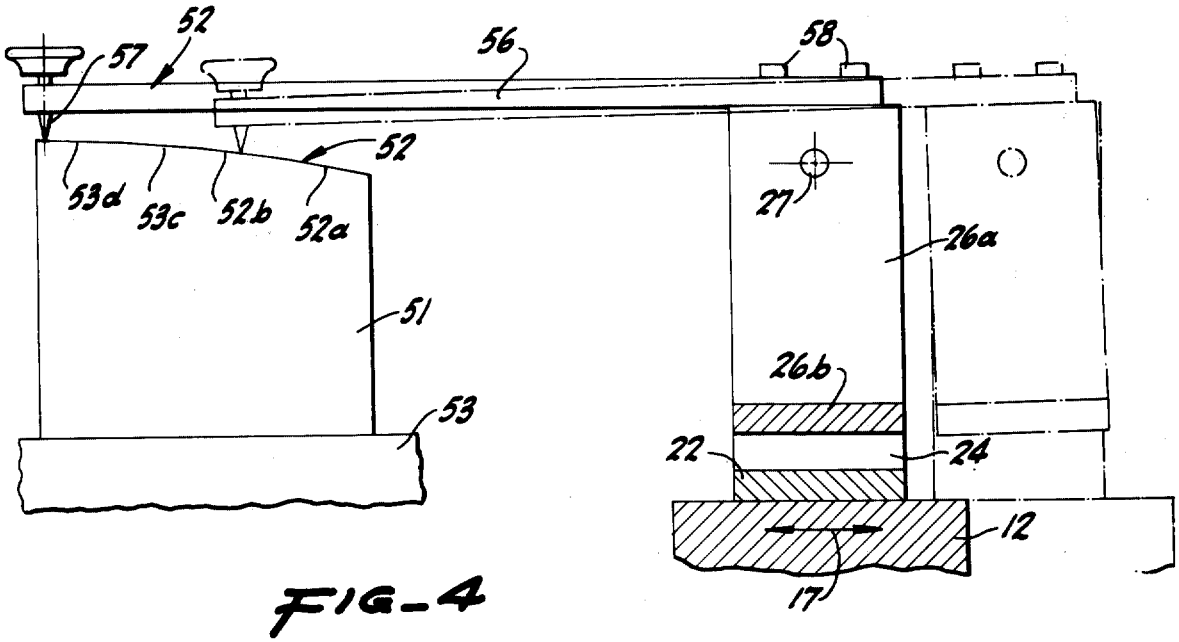
FIG. 4 is a sectional view of a second embodiment of apparatus for dressing regulating wheels according to the invention, taken along a line corresponding to line 4—4 in FIG. 1.

The embodiment illustrated in FIG. 4 is generally similar to the apparatus described above, and like reference numerals are used to designate like elements. In addition to the elements of the previous embodiment, the embodiment of FIG. 4 includes a template 51 and a follower 52 which serve as a guide in the formation of a desired stock removal contour on the face of the regulating wheel.

Template 51 is mounted on a suitable stationary support 53 such as the bed of the surface grinder of which grinding head 11 and carriage 12 are parts. The upper surface 52 of the template has a contour corresponding to the stock removal contour to be formed on the regulating wheel. In the embodiment illustrated, surface 52 has a first section **52*a* corresponding to a bulk removal region on the regulating wheel, a second section 52*b* corresponding to a more gradual stock removal region on the wheel, a third section 53*c* corresponding to a coarse finishing region on the wheel and a fourth region 53*d*** corresponding to a final finishing region on the wheel.

Follower 52 comprises an arm 56 having a point 57 mounted thereon in position for engaging the upper surface of template 51. Arm 56 extends in a direction generally parallel to axis 16 and is affixed to the upper portion of one of the upright arms of cradle 26 by means of screws 58.

Figure 2:
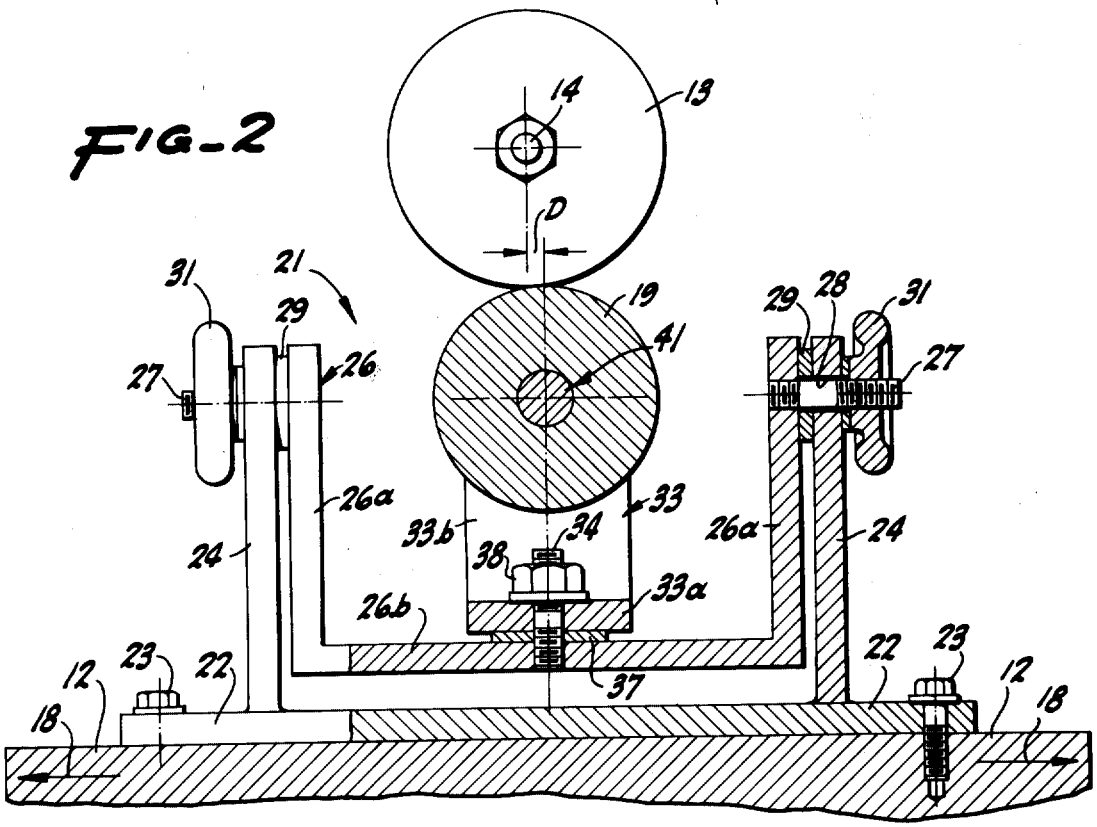
FIG. 2 is a sectional view taken along line 2—2 in FIG. 1.
Figure 3:
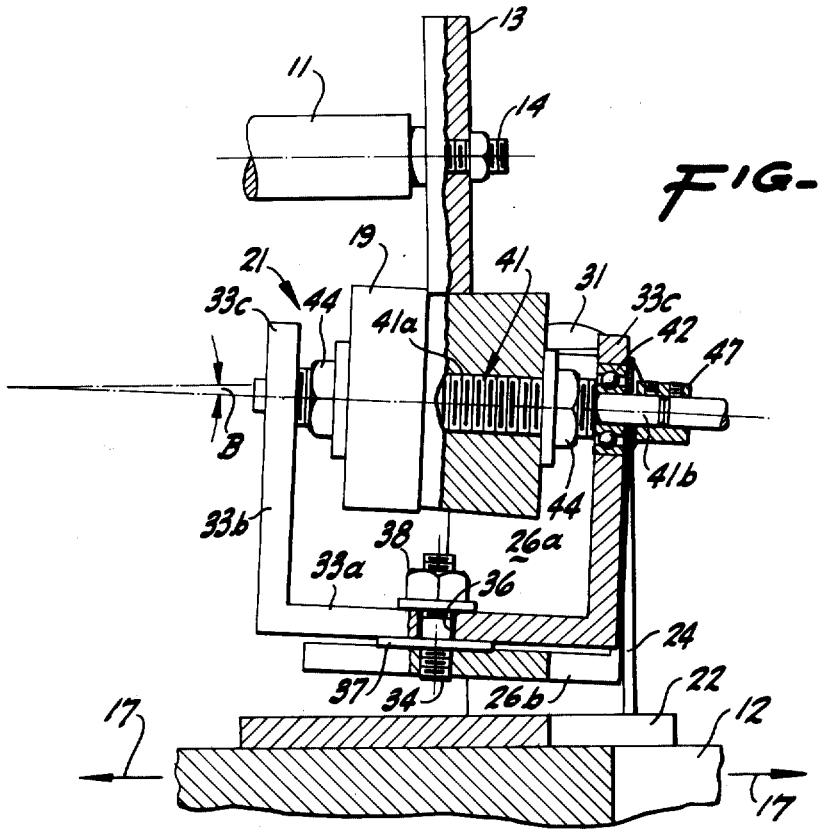
FIG. 3 is a sectional view taken along line 3—3 of FIG. 1, with the gimbal assembly adjusted to incline the axis of the regulating wheel to form the face of the wheel at an angle for removing stock from a workpiece.

Operation and use of the embodiment of FIG. 4 is generally similar to that described above in connection with FIGS. 1–3. However, when the template and follower are used, hand wheels 31 are not tightened and cradle 26 is free to pivot about the axis of studs 27. As carriage 12 is moved in the transverse direction with follower point 57 in contact with the upper surface of template 51, the cradle swings about the axis of the studs, varying angle B between the dressing wheel and the regulating wheel to form the desired contour on the latter.

The invention has a number of important features and advantages. It enables regulating wheels to be dressed faster and more accurately than was possible with the single point technique of the prior art, and it can be utilized with regulating wheels made of materials such as diamond and cubic boron which are too hard to be cut with single point tools.

It is apparent from the foregoing that a new and improved method and apparatus for dressing regulating wheels for centerless grinders have been provided. While only the preferred embodiments have been described, as will be apparent to those familiar with the art, certain changes and modifications can be made without departing from the scope of the invention as defined by the following claims.

I claim:

1. In a method for dressing a regulating wheel for use in a centerless grinding machine wherein the regulating wheel is mounted for rotation about an axis inclined at a predetermined angle relative to the axis of a grinding wheel for holding workpieces against the peripheral cutting edge of the grinding wheel and feeding the workpiece in a direction parallel to the axis of said grinding wheel, the steps of: rotating a dressing wheel about an axis inclined relative to a reference axis by an angle corresponding to the predetermined angle, orienting the axis of the regulating wheel in a plane parallel to the axis of the dressing wheel, rotating the regulating wheel about its axis, and effecting relative movement of the rotating wheels in a direction parallel to the reference axis with the outer periphery of the dressing wheel engaging the outer periphery of the regulating wheel for dressing the same.

2. The method of claim 1 wherein the axis of the regulating wheel is displaced from the axis of the dressing wheel by a predetermined distance in a direction normal to the reference axis and parallel to the plane defined by the reference axis and the axis of the dressing wheel.

3. The method of claim 1 together with the additional step of inclining the axes of the dressing and regulating wheels relative to each other by rotating one of the axes about an axis extending in a direction normal to the reference axis and parallel to the plane defined by the reference axis and the axis of the dressing wheel.

4. In a method for dressing a regulating wheel for use in a centerless grinding machine wherein the regulating wheel is mounted for rotation about an axis inclined at a predetermined non-zero angle relative to the axis of a grinding wheel for holding workpieces against the peripheral cutting edge of the grinding wheel and feeding the workpieces in a direction parallel to the axis of said grinding wheel, the steps of: rotating a dressing wheel about an axis inclined relative to a reference axis by an angle corresponding to the predetermined angle, positioning the regulating wheel in peripheral engagement with the dressing wheel with the axis of the regulating wheel in a predetermined position relative to the axis of the dressing wheel, rotating the regulating wheel about its axis, and moving the rotating regulating wheel in a direction parallel to the reference axis.

5. In apparatus for dressing a regulating wheel for holding workpieces against the peripheral edge of a grinding wheel in a centerless grinding machine and feeding the workpieces in a direction parallel to the axis of the grinding wheel when rotated about an axis inclined at a predetermined angle relative to the axis of the grinding wheel: a dressing wheel mounted for rotation about an axis inclined relative to a reference axis by an angle corresponding to the predetermined angle, carriage means movable in orthogonal directions in a plane parallel to the plane defined by the reference axis and the axis of the dressing wheel, one of the orthogonal directions being parallel to the reference axis, and gimbal means mounted on the carriage means for mounting the regulating wheel in a predetermined position to be peripherally engaged by the dressing wheel when the carriage means is moved in the direction parallel to the reference axis.

6. The apparatus of claim 5 wherein the gimbal means comprises a base affixed to the carriage means, a first gimbal member pivotally mounted on the base for movement about an axis normal to the reference axis and parallel to the plane of the reference axis and the axis of the dressing wheel, a second gimbal member pivotally mounted on the first gimbal member for movement about an axis normal to the axis about which the first gimbal member is pivotally mounted, and means for mounting the regulating wheel on the second gimbal member for rotation about an axis normal to the axis on which the second gimbal member is mounted.

7. The apparatus of claim 5 together with a template mounted in a stationary position and a follower affixed to the gimbal means for engaging the template and pivoting the gimbal means as the carriage means is moved in the direction of the reference axis, wherein the peripheral face of the regulating wheel is formed with a stock removal contour corresponding to the contour of the template.

8. In apparatus for dressing a regulating wheel for holding workpieces against the peripheral edge of a grinding wheel in a centerless grinding machine and feeding the workpiece in a direction parallel to the axis of the grinding wheel when rotated about an axis inclined at a predetermined non-zero angle relative to the axis of the grinding wheel: A dressing wheel mounted for rotation about an axis inclined relative to a reference axis by an angle corresponding to the predetermined angle, means mounting the regulating wheel for rotation about an axis aligned in a predetermined position relative to the axis of the dressing wheel with the dressing wheel peripherally engaging the regulating wheel, the axis of the regulating wheel being inclined at a non-zero angle relative to the reference axis, and means for moving the regulating wheel in a direction parallel to the reference axis.

9. The apparatus of claim 8 including means for shifting the position of the axis of the regulating wheel in a direction normal to the reference axis and parallel to the plane defined by the reference axis and the axis of the dressing wheel.

10. In apparatus for dressing a regulating wheel for holding a workpiece against the peripheral edge of a grinding wheel in a centerless grinding machine and feeding the workpiece in a direction parallel to the axis of the grinding wheel when rotated about an axis inclined at a predetermined angle relative to the axis of the grinding wheel: a dressing wheel mounted for rotation about an axis inclined relative to a reference axis by an angle corresponding to the predetermined angle, means mounting the regulating wheel for rotation in peripheral engagement with the dressing wheel, said means including means for rotating the axis of the regulating wheel to a predetermined position about an axis normal to the plane defined by the reference axis and the axis of the dressing wheel, and means for moving the regulating wheel in a direction parallel to the reference axis.

11. In apparatus for dressing a regulating wheel for holding workpiece against the peripheral edge of a grinding wheel in a centerless grinding machine and feeding the workpiece in a direction parallel to the axis of the grinding wheel when rotated about an axis inclined at a predetermined angle relative to the axis of the grinding wheel: a dressing wheel mounted for rotation about an axis inclined relative to a reference axis by an angle corresponding to the predetermined angle, means mounting the regulating wheel for rotation in peripheral engagement with the dressing wheel, said means including means for rotating the axis of the regulating wheel to a predetermined position about an axis extending in a direction normal to the reference axis and parallel to the plane defined by the reference axis and the axis of the dressing wheel, and means for moving the regulating wheel in a direction parallel to the reference axis.

12. The apparatus of claim 11 together with a template mounted in a stationary position and a follower affixed to the means for mounting the regulating wheel and positioned to engage the template as the regulating wheel is moved parallel to the reference axis, whereby the regulating wheel moves pivotally about the axis normal to the reference axis according to the contour of the template as said wheel is moved parallel to the reference axis.

* * * * *